US008077087B2

(12) United States Patent
Gallivan et al.

(10) Patent No.: US 8,077,087 B2
(45) Date of Patent: Dec. 13, 2011

(54) METHODS AND APPARATUS FOR PHASED ARRAY

(75) Inventors: James R. Gallivan, Pomona, CA (US); Kenneth W. Brown, Yucaipa, CA (US); Reid Lowell, Ontario, CA (US)

(73) Assignee: Raytheon Company, Waltham, MA (US)

( * ) Notice: Subject to any disclaimer, the term of this patent is extended or adjusted under 35 U.S.C. 154(b) by 394 days.

(21) Appl. No.: 12/135,352

(22) Filed: Jun. 9, 2008

(65) Prior Publication Data

US 2008/0303716 A1 Dec. 11, 2008

Related U.S. Application Data

(60) Provisional application No. 60/942,620, filed on Jun. 7, 2007.

(51) Int. Cl.
*H01Q 3/00* (2006.01)
*H01Q 21/29* (2006.01)

(52) U.S. Cl. ..... 342/373; 342/354; 342/368; 343/893

(58) Field of Classification Search ..... 343/844, 343/853, 893, 700 MS, DIG. 2; 710/301, 710/302; 361/728–735, 796, 797; 342/354, 342/368, 373; *H01Q 3/00, 21/00, 21/29*
See application file for complete search history.

(56) References Cited

U.S. PATENT DOCUMENTS 4,445,119 A * 4/1984 Works ..... 342/377
4,949,092 A * 8/1990 Crail et al. ..... 342/354
5,293,171 A * 3/1994 Cherrette ..... 343/700 MS
5,339,086 A * 8/1994 DeLuca et al. ..... 342/371
5,408,237 A * 4/1995 Patterson et al. ..... 342/354
5,613,095 A * 3/1997 Moss et al. ..... 710/301
5,854,607 A * 12/1998 Kinghorn ..... 343/853
5,982,326 A * 11/1999 Chow et al. ..... 342/365
5,994,901 A * 11/1999 McIntyre et al. ..... 324/303
5,995,062 A * 11/1999 Denney et al. ..... 343/853
6,232,920 B1 5/2001 Brookner et al.
6,784,837 B2 * 8/2004 Revankar et al. ..... 342/372
6,989,795 B2 * 1/2006 Edward et al. ..... 343/725
7,034,751 B2 4/2006 Brown et al.
7,053,824 B2 * 5/2006 Abraham ..... 342/357.64
7,151,502 B2 12/2006 Stavros et al.
7,474,249 B1 * 1/2009 Williams et al. ..... 342/25 R
2002/0059492 A1 * 5/2002 Sabotta et al. ..... 710/301
2003/0090417 A1 * 5/2003 Kenyon Vail et al. ..... 342/372
2004/0196203 A1 * 10/2004 Lier et al. ..... 343/824
2004/0225794 A1 * 11/2004 Thornton ..... 710/301
2006/0092075 A1 5/2006 Bruce et al.
2006/0114109 A1 * 6/2006 Geissler ..... 340/539.13

OTHER PUBLICATIONS

Cetin et al., Feature-Enhanced Synthetic Aperture Radar Image Formation Based on Nonquadratic Regularization, Apr. 2001, IEEE Transactions on Image Processing, vol. 10, No. 4, 1057-7149/01$10.00 2001 IEEE, pp. 623-631.*

* cited by examiner

*Primary Examiner* — Thomas Tarcza
*Assistant Examiner* — John Vigushin
(74) *Attorney, Agent, or Firm* — The Noblitt Group, PLLC

(57) ABSTRACT

Methods and apparatus according to various aspects of the present invention operate in conjunction with a phased array system. The phased array system may include an array structural frame defining an array of module-receiving mounting locations. The phased array system may further include multiple array modules. Each array module may be adapted to be mounted in one of the mounting locations, and may include an antenna and a power source. The power source may supply power to the array module during an array transmit operation.

16 Claims, 2 Drawing Sheets

METHODS AND APPARATUS FOR PHASED ARRAY

CROSS-REFERENCES TO RELATED APPLICATIONS

This application claims the benefit of U.S. Provisional Patent Application No. 60/942,620, filed Jun. 7, 2007, and incorporates the disclosure of the application by reference.

BACKGROUND OF INVENTION

Due to their relatively large mass and volume, current phased array techniques are not suitable for use in high average power applications requiring a high degree of mobility or in lightweight systems. Besides the antenna array, support equipment, phase shifters, and power supplies add greatly to the overall weight and volume. In addition, replacing and calibrating replacement phased array modules can be a very time consuming task.

SUMMARY OF THE INVENTION

Methods and apparatus according to various aspects of the present invention operate in conjunction with a phased array system. The phased array system may include an array structural frame defining an array of module-receiving mounting locations. The phased array system may further include multiple array modules. Each array module may be adapted to be mounted in one of the mounting locations, and may include an antenna and a power source. The power source may supply power to the array module during an array transmit operation.

BRIEF DESCRIPTION OF THE DRAWINGS

A more complete understanding of the present invention may be derived by referring to the detailed description and claims when considered in connection with the following illustrative figures. In the following figures, like reference numbers refer to similar elements and steps throughout the figures.

Figure 1:
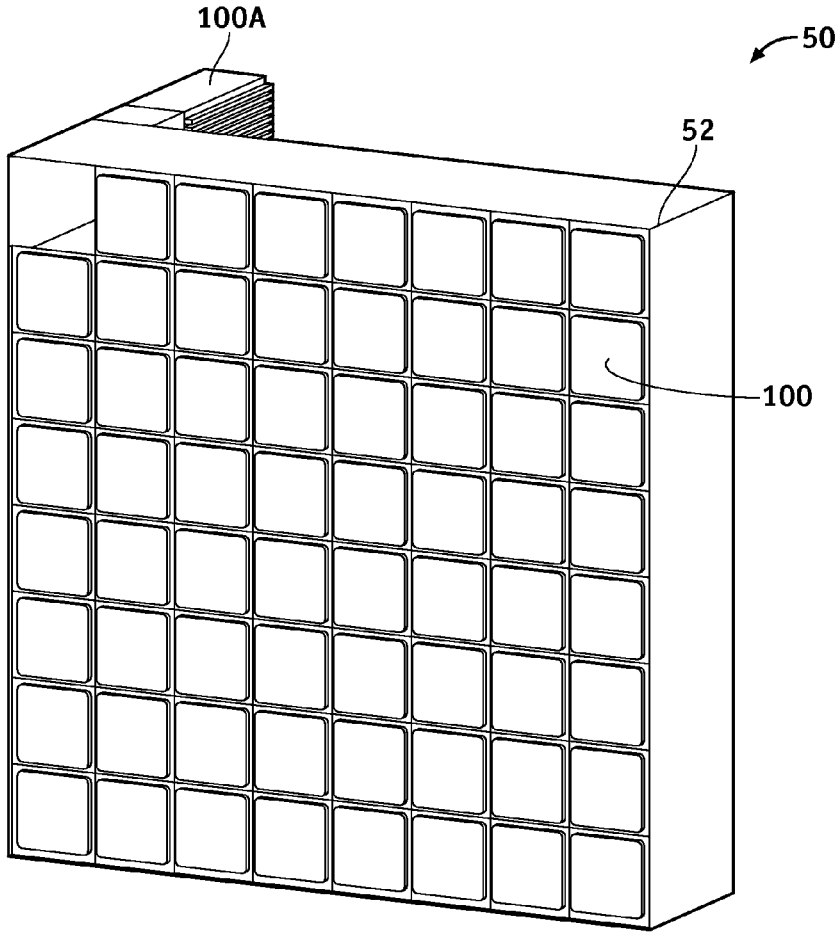
FIG. 1 is a diagrammatic view of a phased array system including a partially removed array module.

Elements and steps in the figures are illustrated for simplicity and clarity and have not necessarily been rendered according to any particular sequence. For example, steps that may be performed concurrently or in different order are illustrated in the figures to help to improve understanding of embodiments of the present invention.

DETAILED DESCRIPTION OF EXEMPLARY EMBODIMENTS

The present invention may be described in terms of functional block components and various processing steps. Such functional blocks may be realized by any number of hardware or software components configured to perform the specified functions and achieve the various results. For example, the present invention may employ various antenna, batteries, phase shifters, frames, computers, controllers, control algorithms, and the like which may carry out a variety of functions. In addition, the present invention may be practiced in conjunction with any number of phased array systems, such as radar systems, communication systems, and directed energy weapons, and the system described is merely one exemplary application for the invention. Further, the present invention may employ any number of conventional techniques for phase shifting, steering, filtering, and the like.

Further, embodiments may be described as including processes or functions that are described in conjunction with flowcharts, flow diagrams, data flow diagrams, structure diagrams, or block diagrams. Although such illustrations may describe the operations as a sequential process, many of the operations can be performed in parallel or concurrently. In addition, the order of the operations may be re-arranged. A process is terminated when its operations are completed, but could have additional steps not included in the figure. A process may correspond to a method, a function, a procedure, a subroutine, a subprogram, etc. When a process corresponds to a function, its termination corresponds to a return of the function to the calling function or the main function.

Furthermore, embodiments may be implemented by hardware, software, firmware, middleware, microcode, hardware description languages, or any combination thereof. When implemented in software, firmware, middleware or microcode, the program code or code segments to perform the necessary tasks may be stored in a medium, such as portable or fixed storage devices, optical storage devices, wireless channels and various other media capable of storing, containing or carrying instructions and/or data, and a processor may perform the necessary tasks. A code segment may represent a procedure, function, subprogram, program, routine, subroutine, module, software package, class, or any combination of instructions, data structures, or program statements. A code segment may be coupled to another code segment or a hardware circuit by passing and/or receiving information, data, arguments, parameters, or memory contents. Information, arguments, parameters, data, etc. may be passed, forwarded, or transmitted via any suitable technique or mechanism including memory sharing, message passing, token passing, network transmission, etc.

Figure 2:
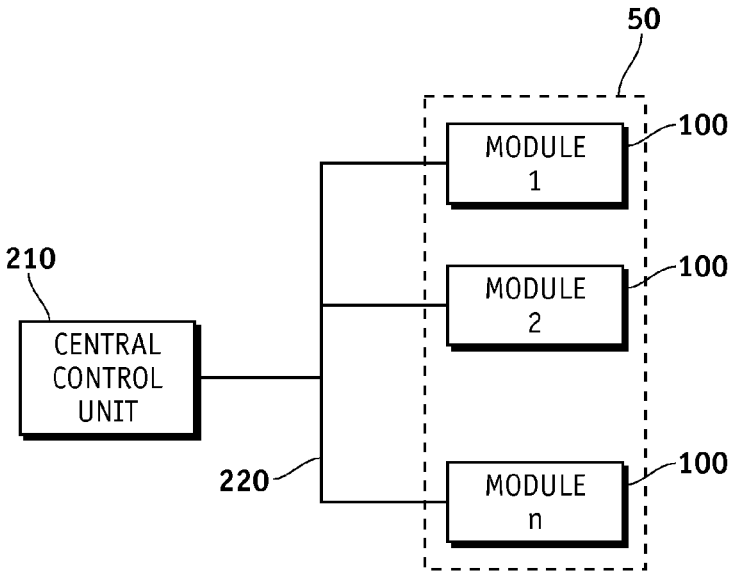
FIG. 2 is a block diagram of a phased array system and a central control unit.

Methods and apparatus for phased arrays according to various aspects of the present invention may operate in conjunction with multiple array modules. For example, referring to FIG. 1, an exemplary embodiment of a phased array system 50 may comprise multiple array modules 100 assembled as an integrated single unit. The phased array system 50 may comprise and/or operate in conjunction with any suitable system utilizing a phased array, such as a communications system, radar system, optics, and weapons. In the present embodiment, the phased array system 50 comprises a directed energy phased array system, such as for a weapon or radar system. For example, the phased array system 50 may comprise a portable, high-power RF transmitter. Referring to FIG. 2, the phased array system 50 may communicate with a central control unit 210 to perform various functions, such as to provide a phase reference or master clock signal, receive control/status and I/O signals, and communicate with status indicators in the various modules, such as battery status indicators.

The central control unit 210 may be coupled to the phased array system 50 via a communications medium 220. The communications medium 220 may comprise any appropriate medium for receiving and/or transmitting signals, such as electrical connections, optical connections, wireless communications, and/or other appropriate media. In the present embodiment, the communications medium 220 comprises fiber optical connections between each of the modules 100 in the phased array system 50 and the central control unit 210 such that the central control unit 210 may communicate with individual modules 100 as well as broadcast to all modules 100 as a whole. For example, the communications medium 220 suitably comprises a system of fiber optic devices, such as fiber optic cables, receivers, and transmitters, adapted to provide the master clock signal for transmission to the individual modules 100 in the array system 50 while maintaining phase/time coherency. In one embodiment, the communications medium 220 may be configured in a tree structure to prevent failure of a large section of the phased array system 50 if an individual fiber optic receiver or other element fails.

The phased array system 50 is a group of array modules 100 configured to operate as a phased array 50 such that the relative phases of the respective signals provided to the antennas of the array modules 100 are varied in such a way that the effective radiation pattern of the phased array system 50 is reinforced in a desired direction and suppressed in undesired directions. The phased array system 50 may comprise any appropriate set of antennas configured to operating as a phased array. In the present embodiment, the phased array system 50 is configured as a mobile unit adapted to operate at high power levels, such as highly mobile, low operational duty applications. While operating, the phased array system 50 may be disconnected from an external power source, and receive master clock and various other signals from the central control unit 210.

The phased array system 50 may comprise any suitable elements to operate as a phased array and support the array modules 100. Referring again to FIG. 1, the phased array system 50 may comprise a frame 52 to support the arrangement of array modules 100. The frame 52 may comprise any suitable structural support for the array modules 100, such as a rigid structure in a generally rectilinear configuration. In the present embodiment, the frame 52 includes multiple slots for each module to be received and supported in a rack-mounted fashion. The array modules 100 may be removably mounted 100A on the frame 52 to facilitate repair and replacement of the array modules 100.

Each module mounting location in the frame 52 may be associated with a location identifier that may be communicated to the central control unit 210, such as via the communications medium 220 and the array module 100 installed at the particular location. For example, when installed in a particular mounting location in the frame 52, the array module 100 may receive the location identifier, such as via an electrical or optical connection or a non-contact device. The location identifier facilitates determining the array module's 100 physical location in the phased array system 50 for calculations and to provide information to the central control unit 210 as to the location of a particular module 100, such as for addressing and phase correction purposes. Automatically establishing the location of an array module 100 within the phased array system 50 may facilitate field replacement of the array modules 100 with fewer and/or less demanding alignment and calibration schemes.

The array modules 100 comprise individual elements of the phased array system 50 for transmitting signals. In one embodiment, the array modules 100 are interchangeable to any physical position in the phased array system 50. The individual connections of the communications medium 220 between each array module 100 and the central control unit 210 may facilitate individual addressing and control of the array modules. Consequently, the phased array system 50 may comprise any suitable number of array modules 100 that may be steered dynamically by the central control unit 210. In addition, the array modules 100 may be configured as relatively small integrated units to facilitate deployment and replacement. An exemplary array module 100 may be less than 30 pounds in weight and one cubic foot in volume, such as less than fifteen pounds and 0.3 cubic feet in volume. Each array module 100 may also include a visual indicator, such as a nonvolatile visual indicator, to display a particular unit that requires service or needs to be located in the phased array system 50.

In one embodiment, such as a phased array system 50 adapted for high power transmission and portability, each array module 100 includes phase shifting electronics, prime power supplies, and control circuits. Each module 100 requires relatively little external structure to operate, such as to provide modulation input and structural support. The array modules 100 may comprise self-contained, field replaceable, high power RF transmitters.

Figure 3:
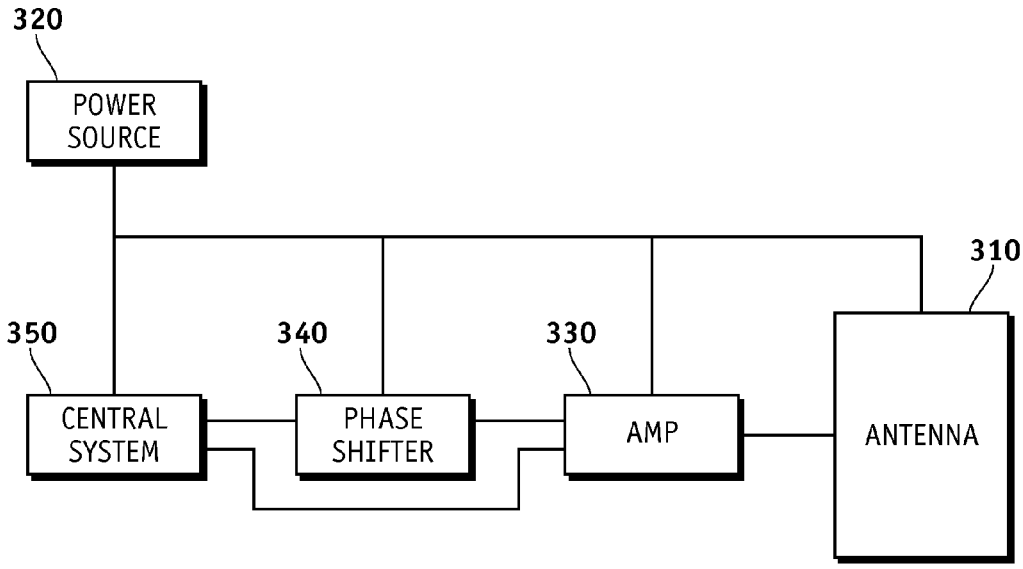
FIG. 3 is a block diagram of an array module.

The array modules may comprise any suitable systems for transmitting signals in the phased array system 50, such as antennas and control circuitry. For example, referring to FIGS. 3 and 4, each array module 100 may include a housing configured to fit into the mounting locations in the frame 52. The housing may contain an antenna 310, such as at one end of the housing, a power source 320, an amplifier 330, a phase shifter 340, and a module control system 350. The antenna 310 generates transmission in response to signals from the amplifier 330. The control system 350 provides signals to the phase shifter 340 to phase shift signals to steer the transmission, and the amplifier 330 amplifies the signals. The power source 320 may provide power to one or more components of the array module 100.

The antenna 310 generates electromagnetic signals in response to an applied electrical signal. The antenna 310 may comprise any appropriate antenna for operating in the phased array system 50. For example, the antenna 310 may comprise a conventional patch antenna. In the present embodiment, the antennas 310 of the various array modules 100 are arranged along a substantially flat plane such that all of the antennas 310 are facing in substantially the same direction.

The power supply 320 provides power to one or more elements of the array module 100. The power supply 320 may comprise any suitable source of power, such as one or more batteries, converters, generators, or other source of electrical power. In the present embodiment, the power supply 320 comprises rechargeable high-power batteries. The batteries may be charged with a lower power, long duty cycle power source that is external to the phased array system 50, such as a lightweight AC/DC converter. The phased array system 50 may be disconnected from the external source for deployment and operation.

Figure 4:
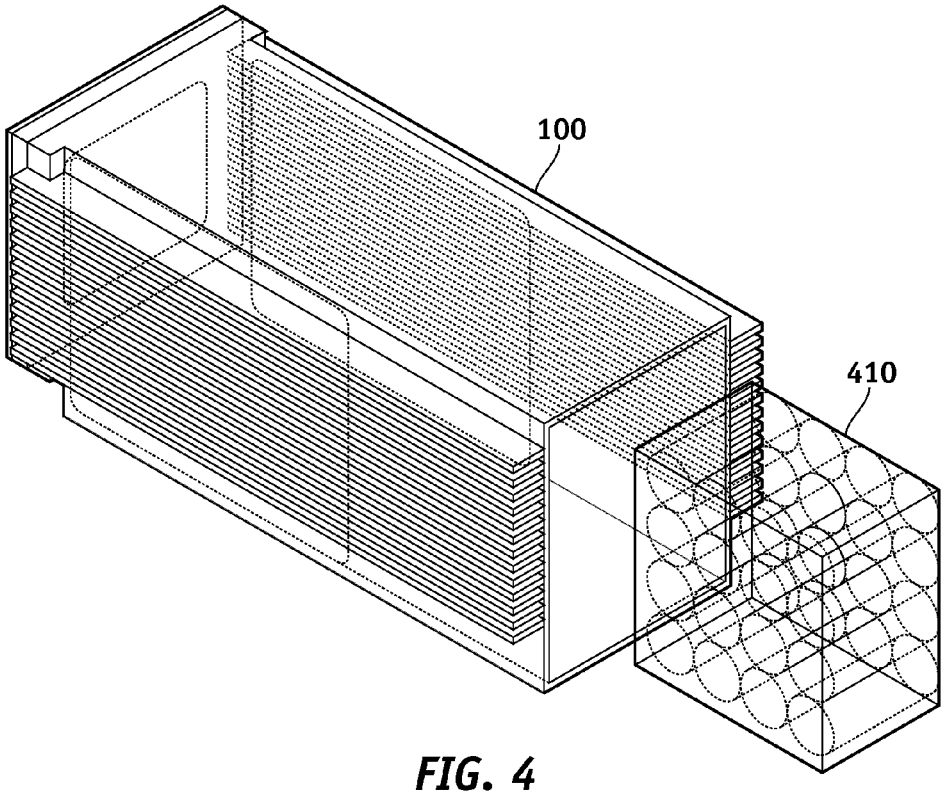
FIG. 4 is a diagrammatic isometric view of an array module including a removed battery pack.

The power supply 320 may comprise a single unit powering the entire phased array system 50, multiple units powering multiple array modules 100, and/or multiple units powering individual array modules. The power supply 320 may comprise multiple battery modules, and each battery module may be associated with fewer than all of the array modules 100 in the array. Referring to FIG. 4, in the present embodiment, the power supply 320 may comprise multiple removable battery modules 410, each of which powers a single array module 100 such that each array module 100 includes a dedicated battery module 410. Each battery module may include batteries and recharge and control electronics.

In one exemplary embodiment, the phased array system 50 is operated in high power transmitting modes in a burst mode. Using bursts allows the power in the batteries to be used until enough bursts have been utilized to require battery recharging.

The burst mode transmissions may also allow the array module 100 to be self-contained, as the heating is only in short bursts so that the transmitters and electronics can be cooled with passive systems, such as adiabatic heat sinks contained in each module, or possibly without dedicated cooling systems. In one embodiment, the array module 100 includes hollow structural elements to circulate cooling air or other fluids. The fluids may be unforced or forced, such as by blowers or bleed air from other systems, such as a turbine power generator. The cooling system may include other cooling systems, however, such as an intercooler and/or a venturi cooling device to lower the temperature of the inlet air to the module.

The phase shifter 340 shifts the phase of signals propagated to the antenna 310 via the amplifier 330 to provide constructive/destructive interference so as to steer the electromagnetic radiation in the desired direction. The phase shifter 340 may comprise any appropriate element or system for selectively shifting the phase of the signals, such as conventional ferrite phase shifters and/or switched line phase shifters.

In one embodiment, the phased array system 50 generates microwave frequencies that are low enough to be phase shifted with low cost and light weight digital delay circuits, and the phase shifter 340 comprises one or more programmable digital time delay integrated circuits, such as differential emitter coupled logic (ECL) microchips. The delay circuits may be programmed to provide selected delays, such as in conjunction with at least four bits of phase shift accuracy. The digital delay circuits tend to reduce the cost, weight, and/or bulk of the phase shifters 340, as conventional ferrite shifters tend to be large and heavy, and switched line phase shifters typically require more space and cost and exhibit greater mass. The output of the phase shifter 340 may be filtered to maintain low RF harmonic content.

The amplifier 330 amplifies the signals from the phase shifter 340 to drive the antenna 310. The amplifier 330 may comprise any appropriate system for generating sufficiently high power signals to drive the antenna 310, such as a high-power, high-gain RF amplifier using RF power MOSFETs.

The module control system 350 controls the operation of the array module 100. The module control system 350 may comprise any appropriate control elements, such as conventional processors, memories, and other components. For example, the module control system 350 may control the phase shifter 340 to dynamically steer the signals generated by the phased array system 50. In the present embodiment, each module control system 350 in the phased array system 50 uses the same set of mathematical algorithms for real time determination of the phase shifting solution.

The module control system 350 may perform any appropriate functions, such as communications control, calculations, module function control, module health monitoring, battery monitoring, battery charging control, determination of module physical location in array, and calibration date. The module control system 350 may communicate with the central control unit 210 to allow autonomous or semi-autonomous operation, such as in the form of built-in test/status reporting, self-calibration, etc.

In addition, each module control system 350 may have access to a unique serial number embedded in silicon on the device. Further, an electronic data sheet for the corresponding array module 100 may be stored in nonvolatile memory. The data sheet nay contain information on factory calibration, field calibration, maintenance history, device errors, failures, etc. that would be applicable to fault diagnosis and/or servicing, and depot level maintenance/repair data and diagnostics.

The central control unit 210 controls various aspects of the phased array system 50, such as directing the electromagnetic radiation generated by the system, the operation of the array modules 100, providing control and clock signals, and calibration functions. The central control unit 210 may comprise any appropriate control system, such as a conventional computer or other controller. In one embodiment, the central control unit 210 uses a communication protocol and physical layer that has been optimized for controlling and monitoring arrays of embedded devices.

The central control unit 210 may generate and/or control a master clock signal and provide it to the array modules 100. In one embodiment, the central control unit 210 includes a tunable master oscillator that is controlled by the central control unit 210. The master oscillator may use the same communications and monitoring features that the individual modules use.

The central control unit 210 may also be configured to calibrate the phased array system 50 and/or the individual array modules. For example, the central control unit 210 may includes functions to calibrate each array module 100 in the field as well as a maintenance environment, and to store the calibration data in a nonvolatile memory. For example, the central control unit 210 may be configured to communicate with calibration tools, such as receiving antennas, equipped with GPS systems or other locator systems to determine the location of the calibration tools relative to the phased array system 50. By placing a receiving antenna in the far field at a known position with respect to the phased array system 50, the central control unit 210 may initially map the array modules' 100 phasing. Each array module 100 may be individually tested and its received phase and magnitude may be measured, which may facilitate calibration of the phase shift offset for each array module 100 in each array location. The offset data may be coded into a correction phase for that array module 100 and/or array location. The offset data may be read, by any array module 100 placed in the array location, to let it transmit the proper phase.

In operation, the central control unit 210 may generate the master clock signal, which is provided via the communications medium 220 to the various array modules 100. The central control unit 210 may also generate control signals for steering the transmissions generated by the phased array system 50.

The control signals may be received by the array modules 100, such as by the module control system 350. The module control system 350 programs the phase shifter 340 to shift the phase of the master clock signal to achieve the required phase for the signal generated by the array module 100. The amplifier 330 amplifies the signal, which is then provided to the antenna 310 to generate the transmission. The power source 320 may provide the power for the various operations, including a high-power burst transmission. When the power source 320 is drained or otherwise between operations, the power source 320 may be connected to a charger to recharge the power source 320.

In the foregoing specification, the invention has been described with reference to specific exemplary embodiments. Various modifications and changes may be made, however, without departing from the scope of the present invention as set forth in the claims. The specification and figures are illustrative, rather than restrictive, and modifications are intended to be included within the scope of the present invention. Accordingly, the scope of the invention should be determined by the claims and their legal equivalents rather than by merely the examples described.

For example, the steps recited in any method or process claims may be executed in any order and are not limited to the specific order presented in the claims. Additionally, the components and/or elements recited in any apparatus claims may be assembled or otherwise operationally configured in a variety of permutations and are accordingly not limited to the specific configuration recited in the claims.

Benefits, other advantages, and solutions to problems have been described above with regard to particular embodiments; however, any benefit, advantage, solution to problem, or any element that may cause any particular benefit, advantage, or solution to occur or to become more pronounced are not to be construed as critical, required, or essential features or components of any or all the claims.

The terms "comprise", "comprises", "comprising", "having", "including", "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles of the same.

The invention claimed is:

1. A phased array system, comprising:

an array structural frame defining an array of module-receiving mounting locations, wherein each mounting location:

forms an open-ended slot within the array structural frame; and includes an identification circuit providing a mounting location identifier and a phase correction indicator corresponding to a physical location of the mounting location within the array structural frame; and multiple array modules, wherein each array module is adapted to:

be mounted in one of the mounting locations;

read the identification circuit to obtain the mounting location identifier and the phase correction indicator, and wherein each array module comprises:

a housing configured to be positioned within the open-ended slot of one of the mounting locations;

a single antenna disposed at one end of the housing and configured to fit within the open-ended slot; and a removable battery module disposed within the housing and adapted to power the array module during a high power burst mode array transmit operation, wherein the removable battery module comprises: at least one rechargeable battery; and recharge and control electronics, wherein the array modules are not connected to an external prime power source during the high power burst mode array transmit operation.

2. A phased array system according to claim 1, wherein each array module further includes a phase shifter disposed within the housing and adapted to shift a phase of signals provided to the antenna.

3. A phased array system according to claim 2, wherein the phase shifter comprises a digital delay integrated circuit.

4. A phased array system according to claim 1, wherein the high power burst mode array transmit operation comprises a microwave transmission.

5. A phased array system according to claim 1, wherein each array module is adapted to receive a master clock signal generated by a central control unit, wherein the master clock signal is communicated to each array module through a communications medium coupled between the central control unit and each array module.

6. A phased array system according to claim 1, wherein each array module is further adapted to be removably mounted within any mounting location of the array structural frame.

7. An array module for use in conjunction with a phased array system having a plurality of open-ended slots arranged within a frame, comprising:

a housing configured for selectively removable placement within any open-ended slot of the phased array system;

a single antenna disposed at one end of the housing and configured to fit within the open-ended slot;

a module control system disposed within the housing and coupled to the single antenna, wherein the module control system is adapted to obtain a mounting location identifier and a phase correction indicator from an identification circuit coupled to the open-ended slot; and a removable battery module disposed within the housing and coupled to the antenna for powering the antenna during a high power burst mode array transmit operation, wherein the removable battery module comprises: at least one rechargeable battery; and recharge and control electronics, wherein the array module is not connected to an external prime power source during the high power burst mode array transmit operation.

8. An array module according to claim 7, further comprising a phase shifter disposed within the housing and coupled to the antenna, wherein the phase shifter is adapted to shift a phase of signals provided to the antenna.

9. An array module according to claim 7, wherein the phase shifter comprises a digital delay integrated circuit.

10. An array module according to claim 7, wherein the high power burst mode array transmit operation comprises a microwave transmission.

11. An array module according to claim 7, wherein the module control system is adapted to receive a master clock signal generated by a central control unit through a communications medium coupled between the central control unit and the array module.

12. An array module according to claim 7, wherein the battery module is configured to be selectively removable from the housing.

13. A phased array system, comprising:

an array structural frame defining an array of module-receiving mounting locations, wherein each module-receiving mounting location forms a recessed slot; and multiple array modules, wherein each array module comprises:

a housing adapted to be removably mounted within the recessed slot of one of the module-receiving mounting locations;

a single antenna disposed at one end of the housing and configured to fit within the recessed slot;

an amplifier disposed within the housing and coupled to the antenna;

a phase shifter disposed within the housing and coupled to the amplifier;

a module control system disposed within the housing and coupled to the phase shifter, wherein the module control system is adapted to obtain a mounting location identifier and a phase correction indicator from an identification circuit coupled to the recessed slot; and a removable battery module disposed within the housing and coupled to the amplifier and adapted to supply electrical power to the amplifier during a high power burst mode array transmit operation, wherein the removable battery module comprises:

at least one rechargeable battery; and recharge and control electronics, wherein the array modules are not connected to an external prime power source during the high power burst mode array transmit operation.

14. A phased array system according to claim 13, wherein the phase shifter comprises a digital delay integrated circuit.

15. A phased array system according to claim 13, the array transmit operation comprises a microwave transmission.

16. A phased array system according to claim 13, wherein the battery module is configured to be selectively removed from the housing.

* * * * *